US012213509B2

(12) United States Patent
Beeson et al.

(10) Patent No.: US 12,213,509 B2
(45) **Date of Patent: *Feb. 4, 2025**

(54) SMOKELESS TOBACCO COMPOSITION COMPRISING TOBACCO-DERIVED MATERIAL AND NON-TOBACCO PLANT MATERIAL

(71) Applicant: R.J. Reynolds Tobacco Company, Winston-Salem, NC (US)

(72) Inventors: Dwayne William Beeson, Kernersville, NC (US); Jack Gray Flinchum, Jr., Clemmons, NC (US); Huamin Gan, Clemmons, NC (US)

(73) Assignee: R.J. Reynolds Tobacco Company, Winston-Salem, NC (US)

( * ) Notice: Subject to any disclaimer, the term of this patent is extended or adjusted under 35 U.S.C. 154(b) by 639 days.

This patent is subject to a terminal disclaimer.

(21) Appl. No.: 16/452,993

(22) Filed: Jun. 26, 2019

(65) Prior Publication Data

US 2019/0313689 A1 Oct. 17, 2019

Related U.S. Application Data

(60) Continuation of application No. 14/659,805, filed on Mar. 17, 2015, now Pat. No. 10,342,251, which is a (Continued)

(51) Int. Cl.
*A24B 13/00* (2006.01)
*A24B 15/16* (2020.01)

(Continued)

(52) U.S. Cl.
CPC ..... *A24B 13/00* (2013.01); *A24B 15/16* (2013.01); *A24B 15/18* (2013.01); *A24B 15/24* (2013.01); *A24B 15/30* (2013.01)

(58) Field of Classification Search
None
See application file for complete search history.

(56) References Cited

U.S. PATENT DOCUMENTS 2,930,720 A 3/1960 Finberg
3,323,524 A 6/1967 Shamberger, Jr.

(Continued)

FOREIGN PATENT DOCUMENTS

CN 1689468 11/2005
CN 1907149 2/2007

(Continued)

OTHER PUBLICATIONS

Bryzgalov et al., "Comparative Life Cycle Assessment of General Loose and Portion Snus", *1N1800 Life Cycle Assessment*, 2005, pp. 1-23.

(Continued)

*Primary Examiner* — Phu H Nguyen
(74) *Attorney, Agent, or Firm* — Womble Bond Dickinson (US) LLP

(57) ABSTRACT

A smokeless tobacco product is configured for insertion into the mouth of a user and incorporates materials from *Nicotiana* species (e.g., tobacco-derived materials) and plant materials from non-*Nicotiana* species (e.g., non-tobacco plant materials). The tobacco material can have the form of processed tobacco material (e.g., granulated, reconstituted, heat treated, or otherwise processed tobacco laminae and/or stem), tobacco extract (e.g., an extract of water soluble tobacco components obtained by extracting tobacco with water), or a combination thereof. The non-tobacco material can have the form of vegetable pulp (e.g., sugar beet pulp), pulp obtained after removal of water soluble components as a result of water extraction treatment, or a combination thereof. The tobacco product is composed of a mixture of the tobacco material and non-tobacco material components;

(Continued)

such as a mixture of tobacco material, tobacco extract and processed non-tobacco material, or a mixture of aqueous tobacco extract and water-extracted vegetable pulp.

17 Claims, 1 Drawing Sheet

Related U.S. Application Data division of application No. 12/756,656, filed on Apr. 8, 2010, now Pat. No. 9,039,839.

(51) Int. Cl.

| | |
|---|---|
| ***A24B 15/18*** | (2006.01) |
| ***A24B 15/24*** | (2006.01) |
| ***A24B 15/30*** | (2006.01) |

(56) References Cited

U.S. PATENT DOCUMENTS

| | | | | |
|---|---|---|---|---|
| 3,369,551 | A | 2/1968 | Carroll | |
| 3,612,063 | A | 10/1971 | Briskin | |
| 3,703,177 | A | 11/1972 | Hind et al. | |
| 3,818,915 | A | 6/1974 | Anderson | |
| 3,844,294 | A | 10/1974 | Webster | |
| 3,964,495 | A | 6/1976 | White | |
| 4,079,742 | A | 3/1978 | Rainer et al. | |
| 4,144,895 | A | 3/1979 | Fiore | |
| 4,148,325 | A | 4/1979 | Solomon et al. | |
| 4,150,677 | A | 4/1979 | Osborne, Jr. et al. | |
| 4,201,228 | A | 5/1980 | Lewinger | |
| 4,233,993 | A | 11/1980 | Miano et al. | |
| 4,256,126 | A | 3/1981 | Seligman et al. | |
| 4,267,847 | A | 5/1981 | Reid | |
| 4,289,147 | A | 9/1981 | Wildman et al. | |
| 4,306,578 | A * | 12/1981 | Schmidt | A24B 15/30 131/353 |
| 4,333,484 | A | 6/1982 | Keritsis | |
| 4,351,346 | A | 9/1982 | Brummer et al. | |
| 4,359,059 | A | 11/1982 | Brummer et al. | |
| 4,506,682 | A | 3/1985 | Muller | |
| 4,534,372 | A | 8/1985 | White | |
| 4,574,819 | A | 3/1986 | Rainer et al. | |
| 4,589,428 | A | 5/1986 | Keritsis | |
| 4,605,016 | A | 8/1986 | Soga et al. | |
| 4,716,911 | A | 1/1988 | Poulose et al. | |
| 4,727,889 | A | 3/1988 | Niven, Jr. et al. | |
| 4,887,618 | A | 12/1989 | Bernasek et al. | |
| 4,907,605 | A | 3/1990 | Ray et al. | |
| 4,941,484 | A | 7/1990 | Clapp et al. | |
| 4,967,771 | A | 11/1990 | Fagg et al. | |
| 4,986,286 | A | 1/1991 | Roberts et al. | |
| 4,987,907 | A | 1/1991 | Townend | |
| 4,991,599 | A | 2/1991 | Tibbetts | |
| 5,005,593 | A | 4/1991 | Fagg | |
| 5,018,540 | A | 5/1991 | Grubbs et al. | |
| 5,074,319 | A | 12/1991 | White et al. | |
| 5,099,862 | A | 3/1992 | White et al. | |
| 5,121,757 | A | 6/1992 | White et al. | |
| 5,131,415 | A | 7/1992 | Munoz et al. | |
| 5,137,744 | A | 8/1992 | Cagley et al. | |
| 5,148,819 | A | 9/1992 | Fagg | |
| 5,197,494 | A | 3/1993 | Kramer | |
| 5,213,836 | A | 5/1993 | McGillivray et al. | |
| 5,230,354 | A | 7/1993 | Smith et al. | |
| 5,234,008 | A | 8/1993 | Fagg | |
| 5,243,999 | A | 9/1993 | Smith | |
| 5,301,694 | A | 4/1994 | Raymond et al. | |
| 5,318,050 | A | 6/1994 | Gonzalez-Parra et al. | |
| 5,343,879 | A | 9/1994 | Teague | |
| 5,387,416 | A | 2/1995 | White et al. | |
| 5,435,325 | A | 7/1995 | Clapp et al. | |
| 5,445,169 | A | 8/1995 | Brinkley et al. | |
| 6,131,584 | A | 10/2000 | Lauterbach | |
| 6,298,859 | B1 | 10/2001 | Kierulff et al. | |
| 6,772,767 | B2 | 8/2004 | Mua et al. | |
| 6,834,654 | B2 | 12/2004 | Williams | |
| 6,895,974 | B2 | 5/2005 | Peele | |
| 6,953,040 | B2 | 10/2005 | Atchley et al. | |
| 7,025,066 | B2 | 4/2006 | Lawson et al. | |
| 7,032,601 | B2 | 4/2006 | Atchley et al. | |
| 7,337,782 | B2 | 3/2008 | Thompson | |
| 7,661,433 | B2 | 2/2010 | Calandro et al. | |
| 9,039,839 | B2 * | 5/2015 | Beeson | A24B 15/24 131/275 |
| 2002/0162563 | A1 | 11/2002 | Williams | |
| 2004/0020503 | A1 | 2/2004 | Williams | |
| 2004/0074508 | A1 | 4/2004 | McAdam et al. | |
| 2005/0178398 | A1 | 8/2005 | Breslin et al. | |
| 2005/0244521 | A1 * | 11/2005 | Strickland | A24B 13/00 424/751 |
| 2006/0037623 | A1 | 2/2006 | Lawrence, Jr. | |
| 2006/0191548 | A1 | 8/2006 | Strickland et al. | |
| 2007/0012328 | A1 * | 1/2007 | Winterson | A24B 13/00 131/347 |
| 2007/0062549 | A1 * | 3/2007 | Holton | A24B 13/00 131/352 |
| 2007/0095356 | A1 | 5/2007 | Winterson et al. | |
| 2007/0186941 | A1 | 8/2007 | Holton, Jr. et al. | |
| 2007/0186942 | A1 | 8/2007 | Strickland et al. | |
| 2008/0029110 | A1 | 2/2008 | Dube et al. | |
| 2008/0029116 | A1 | 2/2008 | Robinson et al. | |
| 2008/0029117 | A1 | 2/2008 | Mua et al. | |
| 2008/0173317 | A1 | 7/2008 | Robinson et al. | |
| 2008/0196730 | A1 | 8/2008 | Engstrom et al. | |
| 2008/0202533 | A1 | 8/2008 | Mishra et al. | |
| 2009/0025738 | A1 | 1/2009 | Mua et al. | |
| 2009/0025739 | A1 | 1/2009 | Brinkley et al. | |
| 2009/0065013 | A1 | 3/2009 | Essen et al. | |
| 2010/0187143 | A1 | 7/2010 | Essen et al. | |

FOREIGN PATENT DOCUMENTS

| | | |
|---|---|---|
| CN | 101049183 | 10/2007 |
| CN | 101125027 | 2/2008 |
| CN | 101233890 | 8/2008 |
| CN | 101254023 | 9/2008 |
| CN | 101273797 | 10/2008 |
| CN | 201349520 | 11/2009 |
| CN | 101617856 | 1/2010 |
| EP | 0 908 109 | 4/1999 |
| GB | 1 412 878 A | 11/1975 |
| GB | 1 501 152 A | 2/1978 |
| SU | 1593617 | 9/1990 |
| WO | WO 03/028491 | 4/2003 |
| WO | WO 2005/063060 | 7/2005 |
| WO | WO 2007/037962 | 4/2007 |
| WO | WO 2008/133563 | 11/2008 |
| WO | WO 2009/015142 | 1/2009 |

OTHER PUBLICATIONS

Hagstrom, "Beet Pulp as a Fiber Source for Horses," 2008, 3 pages.
Kerr, "Extracting Sugar from Beets," 2007, www.sweetbeet.com, 3 pages.
Leffingwell et al., "Tobacco Flavoring for Smoking Products", *R. J. Reynolds Tobacco Company*, 1972, pp. 1-73.

* cited by examiner

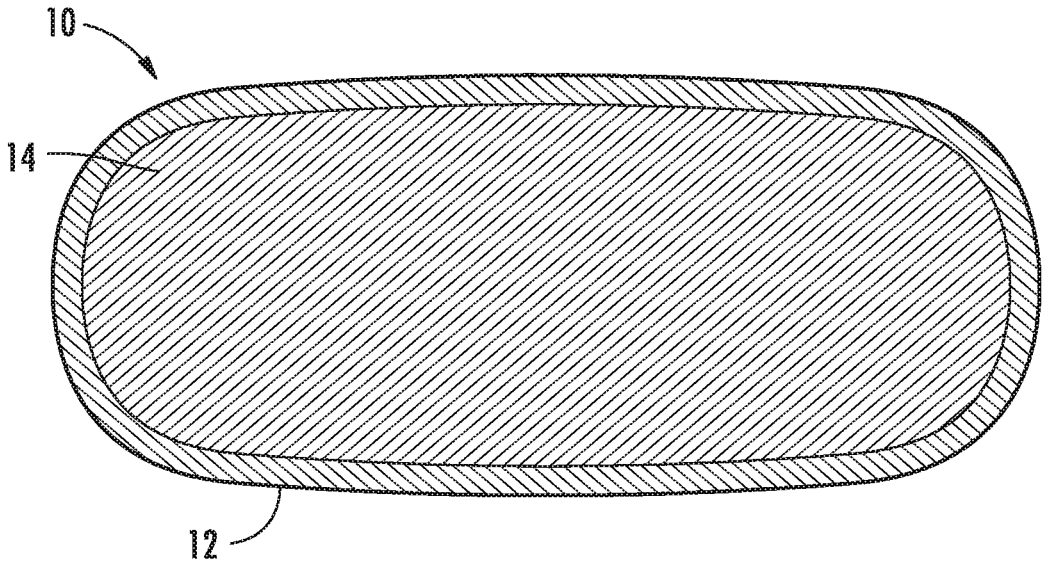
10
14
12

SMOKELESS TOBACCO COMPOSITION COMPRISING TOBACCO-DERIVED MATERIAL AND NON-TOBACCO PLANT MATERIAL

CROSS-REFERENCE TO RELATED APPLICATIONS

The present application is a continuation of U.S. patent application Ser. No. 14/659,805, filed Mar. 17, 2015, which is a divisional of U.S. patent application Ser. No. 12/756,656, filed Apr. 8, 2010, the disclosures of which are incorporated herein by reference in their entireties.

FIELD OF THE INVENTION

The present invention relates to products made or derived from tobacco, or that otherwise incorporate tobacco, and are intended for human consumption. In particular, the invention relates to compositions or formulations incorporating tobacco, and that are intended to be employed in a smokeless form.

BACKGROUND OF THE INVENTION

Cigarettes, cigars and pipes are popular smoking articles that employ tobacco in various forms. Popular smoking articles, such as cigarettes, have a substantially cylindrical rod shaped structure and include a charge, roll or column of smokable material such as shredded tobacco (e.g., in cut filler form) surrounded by a paper wrapper thereby forming a so-called "tobacco rod." Normally, a cigarette has a cylindrical filter element aligned in an end-to-end relationship with the tobacco rod. Typically, a filter element comprises plasticized cellulose acetate tow circumscribed by a paper material known as "plug wrap." Certain cigarettes incorporate a filter element having multiple segments, and one of those segments can comprise activated charcoal particles. Typically, the filter element is attached to one end of the tobacco rod using a circumscribing wrapping material known as "tipping paper." It also has become desirable to perforate the tipping material and plug wrap, in order to provide dilution of drawn mainstream smoke with ambient air. A cigarette is employed by a smoker by lighting one end thereof and burning the tobacco rod. The smoker then receives mainstream smoke into his/her mouth by drawing on the opposite end (e.g., the filter end) of the cigarette.

Various treatment methods and additives have been proposed for altering the overall character or nature of tobacco materials utilized in tobacco products. For example, additives or treatment processes have been utilized in order to alter the chemistry or sensory properties of the tobacco material, or in the case of smokable tobacco materials, to alter the chemistry or sensory properties of mainstream smoke generated by smoking articles including the tobacco material. See, for example, Leffingwell et al., *Tobacco Flavoring for Smoking Products*, R.J. Reynolds Tobacco Company (1972), which is incorporated herein by reference.

Through the years, various natural and synthetic materials have been proposed as substitutes or extenders for tobacco in a variety of tobacco products. See, for example, the types of materials set forth and referenced in U.S. Pat. No. 2,930,720 to Finberg; U.S. Pat. No. 3,323,524 to Shamberger; U.S. Pat. No. 3,369,553 to Carroll; U.S. Pat. No. 3,612,063 to Briskin; U.S. Pat. No. 3,703,177 to Hind et al.; U.S. Pat. No. 3,818,915 to Anderson; U.S. Pat. No. 3,844,294 to Webster; U.S. Pat. No. 4,079,742 to Rainer et al.; U.S. Pat. No. 4,201,228 to Lewinger; U.S. Pat. No. 4,233,993 to Miano; U.S. Pat. No. 4,333,484 to Keritsis et al.; and U.S. Pat. No. 4,534,372 to White; each of which is incorporated herein by reference.

Tobacco also may be enjoyed in a so-called "smokeless" form. Particularly popular smokeless tobacco products are employed by inserting some form of processed tobacco or tobacco-containing formulation into the mouth of the user. Various types of smokeless tobacco products are set forth in U.S. Pat. No. 1,376,586 to Schwartz; U.S. Pat. No. 3,696,917 to Levi; U.S. Pat. No. 4,513,756 to Pittman et al.; U.S. Pat. No. 4,528,993 to Sensabaugh, Jr. et al.; U.S. Pat. No. 4,624,269 to Story et al.; U.S. Pat. No. 4,991,599 to Tibbetts; U.S. Pat. No. 4,987,907 to Townsend; U.S. Pat. No. 5,092,352 to Sprinkle, III et al.; and U.S. Pat. No. 5,387,416 to White et al.; US Pat. Appl. Pub. Nos. 2005/0244521 to Strickland et al.; 2008/0196730 to Engstrom et al.; and 2009/0293889 to Kumar et al.; PCT WO 04/095959 to Arnarp et al.; PCT WO 05/063060 to Atchley et al.; PCT WO 05/004480 to Engstrom; PCT WO 05/016036 to Bjorkholm; PCT WO 05/041699 to Quinter et al. and PCT WO 2009/004488 to Crawford et al.; and U.S. patent application Ser. No. 12/638,394, filed Dec. 15, 2009, to Mua et al.; each of which is incorporated herein by reference. See also, for example, the types of smokeless tobacco formulations, ingredients, and processing methodologies set forth in U.S. Pat. No. 6,953,040 to Atchley et al. and U.S. Pat. No. 7,032,601 to Atchley et al., each of which is incorporated herein by reference.

One type of smokeless tobacco product is referred to as "snuff." Representative types of moist snuff products, commonly referred to as "snus," are manufactured in Europe, particularly in Sweden, by or through companies such as Swedish Match AB, Fiedler & Lundgren AB, Gustavus AB, Skandinavisk Tobakskompagni A/S, and Rocker Production AB. Snus products available in the U.S.A. have been marketed under the tradenames Camel Snus Frost, Camel Snus Original and Camel Snus Spice by R. J. Reynolds Tobacco Company. Representative smokeless tobacco products also have been marketed under the tradenames Oliver Twist by House of Oliver Twist A/S; Copenhagen, Skoal, SkoalDry, Rooster, Red Seal, Husky, and Revel by U.S. Smokeless Tobacco Co.; "taboka" by Philip Morris USA; Levi Garrett, Peachy, Taylor's Pride, Kodiak, Hawken Wintergreen, Grizzly, Dental, Kentucky King, and Mammoth Cave by Conwood Sales Co., L.P.; and Camel Orbs, Camel Sticks, and Camel Strips by R. J. Reynolds Tobacco Company. See also, for example, Bryzgalov et al., 1N1800 Life Cycle Assessment, Comparative Life Cycle Assessment of General Loose and Portion Snus (2005). In addition, certain quality standards associated with snus manufacture have been assembled as a so-called GothiaTek standard.

The sensory attributes of smokeless tobacco can also be enhanced by incorporation of certain flavoring materials. See for example, the types of smokeless tobacco formulations, ingredients, and processing methodologies set forth in U.S. Pat. No. 6,834,654 to Williams; U.S. Pat. No. 6,953,040 to Atchley et al.; and U.S. Pat. No. 7,032,601 to Atchley et al.; US Pat. Appl. Pub. Nos. 2002/0162562 to Williams; 2003/0070687 to Atchley et al.; 2004/0020503 to Williams, 2005/0178398 to Breslin et al.; 2006/0191548 to Strickland et al.; 2007/0062549 to Holton, Jr. et al.; 2007/0186941 to Holton, Jr. et al.; 2007/0186942 to Strickland et al.; 2008/0029110 to Dube et al.; 2008/0029117 to Mua et al.; 2008/0173317 to Robinson et al.; 2008/0209586 to Neilsen et al., and 2009/0065013 to Essen et al., each of which is incorporated herein by reference.

It would be desirable to provide an enjoyable form of tobacco product, such as a smokeless tobacco product, and to provide processes for preparing tobacco-containing compositions suitable for use in smokeless tobacco products.

SUMMARY OF THE INVENTION

The present invention relates to a tobacco product, most preferably a smokeless tobacco product intended or configured for insertion into the mouth of a user, and to processes for preparing a formulation suitable for use within such a smokeless tobacco product. The present invention relates to tobacco products, and in particular, smokeless tobacco products, that incorporate materials from *Nicotiana* species (e.g., tobacco-derived materials) and plant materials from non-*Nicotiana* species (e.g., non-tobacco plant materials). As such, a smokeless tobacco product can exhibit highly desirable sensory attributes, while possessing a reduced overall tobacco content and potentially reduced cost (e.g., depending upon factors such as the non-tobacco plant material that is selected).

The tobacco material can have the form of processed tobacco material (e.g., granulated, reconstituted, heat treated, or otherwise processed tobacco laminae and/or stem), tobacco extract (e.g., an extract of water soluble tobacco components obtained by extracting tobacco with water), or a combination thereof. The non-tobacco material can have the form of vegetable pulp (e.g., processed sugar beet pulp), pulp obtained after removal of water soluble components as a result of water extraction treatment, or a combination thereof. The tobacco product is composed of a mixture of the tobacco material and non-tobacco material components; such as a mixture of tobacco material, tobacco extract and processed non-tobacco material, or a mixture of aqueous tobacco extract and water-extracted vegetable pulp.

In one embodiment, the invention provides a smokeless tobacco composition adapted for oral use, the smokeless tobacco composition comprising a non-tobacco plant material carrying a sorbed aqueous tobacco extract. The weight ratio of non-tobacco plant material to aqueous tobacco extract can be, for example, about 2:1 to about 1:2 or about 1.5:1 to about 1:1.5.

The non-tobacco plant material is typically in particulate form, such as a particulate material having an average particle size of about 0.3 to about 2 mm or about 0.5 to about 1.5 mm. In certain embodiments, the non-tobacco plant material is in the form of an aqueous-extracted pulp material, such as an aqueous-extracted pulp material comprising no more than about 20 weight percent aqueous soluble non-tobacco material on a dry weight basis, or no more than about 10 weight percent aqueous soluble non-tobacco material on a dry weight basis. The non-tobacco plant material typically comprises vegetable or fruit material, although other fibrous plant materials can be used. Exemplary non-tobacco plant materials include sugar beet, wheat, oat, corn, potato, pea, apple, cotton, bamboo, and combinations thereof. In one embodiment, the non-tobacco plant material is an extracted beet material (e.g., an aqueous-extracted sugar beet material).

The smokeless tobacco composition may further include various additives, such as flavorants, fillers, binders, buffering agents, colorants, humectants, oral care additives, preservatives, syrups, disintegration aids, antioxidants, additives derived from an herbal or botanical source, flow aids, and combinations thereof. In certain embodiments, the smokeless tobacco composition includes a natural or artificial sweetener, a salt, a buffering agent, a flow aid, a humectant, or a combination thereof. The composition can further include a second tobacco material, such as a particulate tobacco material.

An exemplary smokeless tobacco composition of the invention comprises about 25 to about 95 dry weight percent of the non-tobacco plant material in the form of an aqueous-extracted pulp material carrying the sorbed aqueous tobacco extract, up to about 5 dry weight percent of one or more natural or artificial sweeteners, up to about 5 dry weight percent of one or more buffering agents, and up to about 5 dry weight percent of one or more salts. In another embodiment, a smokeless tobacco composition of the invention comprises: at least about 20 weight percent of the non-tobacco plant material carrying the sorbed aqueous tobacco extract, based on the total dry weight of the smokeless tobacco composition, wherein the non-tobacco plant material is in the form of a particulate, aqueous-extracted pulp material, and the weight ratio of non-tobacco plant material to aqueous tobacco extract is about 2:1 to about 1:2; about 0.5 to about 10 weight percent of one or more buffering agents; about 0.5 to about 5 weight percent of one or more natural or artificial sweeteners; about 0.5 to about 5 weight percent of one or more humectants; and about 0.5 to about 5 weight percent of one or more salts. In this embodiment, the non-tobacco plant material carrying the sorbed aqueous tobacco extract typically comprises at least about 80 weight percent of the total dry weight of the smokeless tobacco composition, although lesser amounts can be used when the smokeless tobacco composition further includes a second tobacco material, such as a particulate tobacco material.

In another aspect, the present invention provides a water-permeable pouch containing the smokeless tobacco composition according to the invention, and a smokeless tobacco package comprising a plurality of such water-permeable pouches.

In yet another aspect, the present invention provides a process for preparing a composition suitable for use as a smokeless tobacco composition, comprising mixing a tobacco material and a non-tobacco plant material. For example, a water-extracted non-tobacco plant material can be combined with an aqueous tobacco extract such that the aqueous tobacco extract is absorbed into the non-tobacco extracted plant material, thereby forming a smokeless tobacco material.

In one embodiment, the invention provides a process for preparing a composition suitable for use as a smokeless tobacco composition, comprising:

- mixing a non-tobacco plant material with an aqueous tobacco extract such that the aqueous tobacco extract is sorbed into the non-tobacco plant material, thereby forming a smokeless tobacco material (e.g., spraying the aqueous tobacco extract in liquid form into an agitated tank containing the non-tobacco plant material);
- pasteurizing both the aqueous tobacco extract and the non-tobacco plant material either prior to or after said mixing step; and
- adding one or more additives either to the smokeless tobacco material during or after said mixing step or to one or both of the aqueous tobacco extract and the non-tobacco plant material prior to said mixing step, the one or more additives being selected from the group consisting of buffering agents, natural or artificial sweeteners, flow aids, humectants, salts, and combinations thereof. If desired, the resulting smokeless tobacco composition can be further mixed with a second tobacco material, such as a particulate tobacco material conventionally used in smokeless tobacco products such as snus.

The process for preparing the smokeless tobacco composition can include further optional steps, such as extracting a water-soluble portion of a tobacco material in order to form the aqueous tobacco extract, and concentrating or diluting the aqueous tobacco extract, as needed, in order to achieve a solids content (i.e., content of aqueous soluble tobacco pulp) of about 20 to about 60 weight percent (e.g., about 30 to about 50 weight percent). The process may also include extracting a water-soluble portion of a non-tobacco plant material in order to form an extracted pulp material, which can be optionally dried to a moisture content of, for example, no more than about 10 weight percent, no more than about 5 weight percent, or no more than about 1 weight percent. The non-tobacco extracted pulp material is typically mixed with the aqueous extract while in a dried state.

The pasteurizing process used in the invention can vary. In one embodiment, the aqueous tobacco extract is pasteurized by heat treatment at elevated temperature (e.g., at a temperature of at least 75° C. or at least about 80° C. or at least about 85° C.) prior to mixing with the non-tobacco plant material. In this embodiment, a buffering agent is optionally combined with the aqueous tobacco extract while the extract is maintained at an elevated temperature (e.g., above about 25° C.) and prior to mixing the extract with the non-tobacco plant material. The amount of buffering material can vary, but will often be sufficient to raise the pH of the aqueous tobacco extract to at least about 7.5, or at least about 8.0, or at least about 8.5.

In one embodiment, an extracted non-tobacco plant material is pasteurized through the use of an elevated temperature during the aqueous extraction process (e.g., at a temperature of at least 75° C. or at least about 80° C. or at least about 85° C.) prior to mixing the extracted non-tobacco plant material with the aqueous tobacco extract.

Alternatively, pasteurization can be accomplished by heat treatment of the combined tobacco extract/non-tobacco plant material mixture at elevated temperatures (e.g., at a temperature of at least 75° C. or at least about 80° C. or at least about 85° C.). If the combined material is pasteurized as a mixture, a buffering agent can be optionally combined with the combined material at an elevated temperature (e.g., above about 25° C.). The amount of buffering material can vary, but will often be sufficient to raise the pH of the combined material to at least about 7.5, or at least about 8.0, or at least about 8.5.

The addition of various additives can occur at various stages of the process. Typically, humectants, sweeteners, or other flavorants are added in the final stages of the process after the aqueous tobacco extract and the non-tobacco plant material have been combined. A salt additive can also be added to the combined tobacco extract/non-tobacco plant material, or added to the aqueous tobacco extract prior to pasteurization of the extract, or added to the extracted non-tobacco plant material prior to drying of that material.

BRIEF DESCRIPTION OF THE DRAWING

In order to provide an understanding of embodiments of the invention, reference is made to the appended drawing, which is not necessarily drawn to scale, and in which reference numerals refer to components of an exemplary embodiment of the invention. The drawing is exemplary only, and should not be construed as limiting the invention.

The FIGURE is a cross-sectional view of a smokeless tobacco product embodiment, taken across the width of the product, showing an outer pouch filled with the smokeless tobacco composition of the invention.

DETAILED DESCRIPTION OF THE PREFERRED EMBODIMENTS

The present invention now will be described more fully hereinafter. This invention may, however, be embodied in many different forms and should not be construed as limited to the embodiments set forth herein; rather, these embodiments are provided so that this disclosure will be thorough and complete, and will fully convey the scope of the invention to those skilled in the art. As used in this specification and the claims, the singular forms "a," "an," and "the" include plural referents unless the context clearly dictates otherwise. Reference to "dry weight percent" or "dry weight basis" refers to weight on the basis of dry ingredients (i.e., all ingredients except water).

The present invention provides a smokeless tobacco composition that comprises both a tobacco material and a non-tobacco plant material. An exemplary composition of the invention includes a mixture of an aqueous tobacco extract and a water-extracted vegetable pulp, which is optionally further combined with a second tobacco material such as a particulate tobacco material of the type used in conventional smokeless tobacco products such as snus. Referring to the FIGURE, a representative snus type of tobacco product using the smokeless tobacco material of the present invention is shown. In particular, the FIGURE illustrates a smokeless tobacco product 10 having a water-permeable outer pouch 12 containing a smokeless tobacco composition 14.

The tobacco compositions or products incorporate some form of a plant of the *Nicotiana* species, and most preferably, those compositions or products incorporate some form of tobacco. The selection of the *Nicotiana* species can vary; and in particular, the selection of the types of tobacco or tobaccos may vary. Tobaccos that can be employed include flue-cured or Virginia (e.g., K326), burley, sun-cured (e.g., Indian Kurnool and Oriental tobaccos, including Katerini, Prelip, Komotini, Xanthi and Yambol tobaccos), Maryland, dark, dark-fired, dark air cured (e.g., Passanda, Cubano, Jatin and Bezuki tobaccos), light air cured (e.g., North Wisconsin and Galpao tobaccos), Indian air cured, Red Russian and Rustica tobaccos, as well as various other rare or specialty tobaccos. Descriptions of various types of tobaccos, growing practices and harvesting practices are set forth in *Tobacco Production, Chemistry and Technology*, Davis et al. (Eds.) (1999), which is incorporated herein by reference. Various representative other types of plants from the *Nicotiana* species are set forth in Goodspeed, *The Genus Nicotiana*, (Chonica Botanica) (1954); U.S. Pat. No. 4,660,577 to Sensabaugh, Jr. et al.; U.S. Pat. No. 5,387,416 to White et al. and U.S. Pat. No. 7,025,066 to Lawson et al.; US Patent Appl. Pub. Nos. 2006/0037623 to Lawrence, Jr. and 2008/0245377 to Marshall et al.; each of which is incorporated herein by reference. Of particular interest are *N. alata, N. arentsii, N. excelsior, N. forgetiana, N. glauca, N. glutinosa, N. gossei, N. kawakamii, N. knightiana, N. langsdorffi, N. otophora, N. setchelli, N. sylvestris, N. tomentosa, N. tomentosiformis, N. undulata*, and *N.* x *sanderae*. Also of interest are *N. africana, N. amplexicaulis, N. benavidesii, N. bonariensis, N. debneyi, N. longiflora, N. maritina, N. megalosiphon, N. occidentalis, N. paniculata, N. plumbaginifolia, N. raimondii, N. rosulata, N. simulans, N. stock-*

*tonii, N. suaveolens, N. umbratica, N. velutina*, and *N. wigandioides*. Other plants from the *Nicotiana* species include *N. acaulis, N. acuminata, N. attenuata, N. benthamiana, N. cavicola, N. clevelandii, N. cordifolia, N. corymbosa, N. fragrans, N. goodspeedii, N. linearis, N. miersii, N. nudicaulis, N. obtusifolia, N. occidentalis* subsp. *Hersperis, N. pauciflora, N. petunioides, N. quadrivalvis, N. repanda, N. rotundifolia, N. solanifolia* and *N. spegazzinii.*

*Nicotiana* species can be derived using genetic-modification or crossbreeding techniques (e.g., tobacco plants can be genetically engineered or crossbred to increase or decrease production of components, characteristics or attributes). See, for example, the types of genetic modifications of plants set forth in U.S. Pat. No. 5,539,093 to Fitzmaurice et al.; U.S. Pat. No. 5,668,295 to Wahab et al.; U.S. Pat. No. 5,705,624 to Fitzmaurice et al.; U.S. Pat. No. 5,844,119 to Weigl; U.S. Pat. No. 6,730,832 to Dominguez et al.; U.S. Pat. No. 7,173,170 to Liu et al.; U.S. Pat. No. 7,208,659 to Colliver et al. and U.S. Pat. No. 7,230,160 to Benning et al.; US Patent Appl. Pub. No. 2006/0236434 to Conkling et al.; and PCT WO 2008/103935 to Nielsen et al.

For the preparation of smokeless and smokable tobacco products, it is typical for harvested plant of the *Nicotiana* species to be subjected to a curing process. Descriptions of various types of curing processes for various types of tobaccos are set forth in *Tobacco Production, Chemistry and Technology*, Davis et al. (Eds.) (1999). Exemplary techniques and conditions for curing flue-cured tobacco are set forth in Nestor et al., *Beitrage Tabakforsch. Int.,* 20, 467-475 (2003) and U.S. Pat. No. 6,895,974 to Peele, which are incorporated herein by reference. Representative techniques and conditions for air curing tobacco are set forth in U.S. Pat. No. 7,650,892 to Groves et al.; Roton et al., *Beitrage Tabakforsch. Int.,* 21, 305-320 (2005) and Staaf et al., *Beitrage Tabakforsch. Int.,* 21, 321-330 (2005), which are incorporated herein by reference. Certain types of tobaccos can be subjected to alternative types of curing processes, such as fire curing or sun curing. Preferably, harvested tobaccos that are cured are then aged. As such, tobaccos used for the preparation of tobacco compositions or products most preferably incorporate components of tobaccos that have been cured and aged.

At least a portion of the plant of the *Nicotiana* species (e.g., at least a portion of the tobacco portion) can be employed in an immature form. That is, the plant, or at least one portion of that plant, can be harvested before reaching a stage normally regarded as ripe or mature. As such, for example, tobacco can be harvested when the tobacco plant is at the point of a sprout, is commencing leaf formation, is commencing flowering, or the like.

At least a portion of the plant of the *Nicotiana* species (e.g., at least a portion of the tobacco portion) can be employed in a mature form. That is, the plant, or at least one portion of that plant, can be harvested when that plant (or plant portion) reaches a point that is traditionally viewed as being ripe, over-ripe or mature. As such, for example, through the use of tobacco harvesting techniques conventionally employed by farmers, Oriental tobacco plants can be harvested, burley tobacco plants can be harvested, or Virginia tobacco leaves can be harvested or primed by stalk position.

After harvest, the plant of the *Nicotiana* species, or portion thereof, can be used in a green form (e.g., tobacco can be used without being subjected to any curing process). For example, tobacco in green form can be frozen, subjected to irradiation, yellowed, dried, cooked (e.g., roasted, fried or boiled), or otherwise subjected to storage or treatment for later use. Such tobacco also can be subjected to aging conditions.

At least a portion of the plant of the *Nicotiana* species (e.g., tobacco) employed for the tobacco composition or product can have the form of an extract, such as a tobacco extract. Exemplary techniques for extracting components of tobacco are described in U.S. Pat. No. 4,144,895 to Fiore; U.S. Pat. No. 4,150,677 to Osborne, Jr. et al.; U.S. Pat. No. 4,267,847 to Reid; U.S. Pat. No. 4,289,147 to Wildman et al.; U.S. Pat. No. 4,351,346 to Brummer et al.; U.S. Pat. No. 4,359,059 to Brummer et al.; U.S. Pat. No. 4,506,682 to Muller; U.S. Pat. No. 4,589,428 to Keritsis; U.S. Pat. No. 4,605,016 to Soga et al.; U.S. Pat. No. 4,716,911 to Poulose et al.; U.S. Pat. No. 4,727,889 to Niven, Jr. et al.; U.S. Pat. No. 4,887,618 to Bernasek et al.; U.S. Pat. No. 4,941,484 to Clapp et al.; U.S. Pat. No. 4,967,771 to Fagg et al.; U.S. Pat. No. 4,986,286 to Roberts et al.; U.S. Pat. No. 5,005,593 to Fagg et al.; U.S. Pat. No. 5,018,540 to Grubbs et al.; U.S. Pat. No. 5,060,669 to White et al.; U.S. Pat. No. 5,065,775 to Fagg; U.S. Pat. No. 5,074,319 to White et al.; U.S. Pat. No. 5,099,862 to White et al.; U.S. Pat. No. 5,121,757 to White et al.; U.S. Pat. No. 5,131,414 to Fagg; U.S. Pat. No. 5,131,415 to Munoz et al.; U.S. Pat. No. 5,148,819 to Fagg; U.S. Pat. No. 5,197,494 to Kramer; U.S. Pat. No. 5,230,354 to Smith et al.; U.S. Pat. No. 5,234,008 to Fagg; U.S. Pat. No. 5,243,999 to Smith; U.S. Pat. No. 5,301,694 to Raymond et al.; U.S. Pat. No. 5,318,050 to Gonzalez-Parra et al.; U.S. Pat. No. 5,343,879 to Teague; U.S. Pat. No. 5,360,022 to Newton; U.S. Pat. No. 5,435,325 to Clapp et al.; U.S. Pat. No. 5,445,169 to Brinkley et al.; U.S. Pat. No. 6,131,584 to Lauterbach; U.S. Pat. No. 6,298,859 to Kierulff et al.; U.S. Pat. No. 6,772,767 to Mua et al.; and U.S. Pat. No. 7,337,782 to Thompson, all of which are incorporated by reference herein.

Tobacco extracts can be obtained by extracting tobacco using a solvent having an aqueous character. Examples of aqueous solvents include distilled water and tap water. As such, aqueous tobacco extracts can be provided by extracting tobacco with water, such that water insoluble pulp material is separated from the aqueous solvent and the water soluble and dispersible tobacco components dissolved and dispersed therein.

The tobacco extract (e.g., an aqueous tobacco extract) can be employed in a variety of forms. For example, the aqueous tobacco extract can be isolated in an essentially solvent free form, such as can be obtained as a result of the use of a spray drying or freeze drying process, or other similar types of processing steps. Alternatively, the aqueous tobacco extract can be employed in a liquid form, and as such, the content of tobacco solubles within the liquid solvent can be controlled by selection of the amount of solvent employed for extraction, concentration of the liquid tobacco extract by removal of solvent, addition of solvent to dilute the liquid tobacco extract, or the like.

The non-tobacco plant material can vary. Such a plant material is obtained from a plant species other than a *Nicotiana* species. Such a plant material typically can be selected from plants such as potato, beet (e.g., sugar beet), grain, pea, apple, and the like. The plant material can be derived from various portions of the plant, including roots, stalks, stems, leaves, flowers, seeds, or combinations thereof. Of interest are plant materials composed of, or derived from, vegetables and/or fruits. Of particular interest are plant materials composed of, or derived from, sugar beet leaf (e.g., a material available as Fibrex 610-22 from International Fiber Corporation). Other exemplary plant materials include processed wheat, oat, corn, potato, pea and apple available as Vitacel from J. Rettenmaier and Sohne GmbH & Co. kg. Preferred materials include those that are digestible by the human digestive system, or that incorporate at least about greater than about 50 percent (on a dry weight basis) materials that are digestible by the human digestive system. Fiber materials, such as those available as Just Fiber White Wheat Fiber, Just Fiber Cotton Seed, Solka-Floc Powdered Cellulose and Just Fiber Bamboo Fiber from International Fiber Corporation, also can be employed as a component of the non-tobacco plant material (e.g., the materials can be used as received, or the materials can be extracted using a solvent such as water).

The non-tobacco plant material can be used in a processed form. For example, the plant material can be dehydrated, heat treated, cooked, irradiated, frozen, subjected to enzymatic treatment, fermented, or the like. In certain preferred embodiments, the non-tobacco plant material can be used in an extracted form, and as such, at least a portion of certain solvent soluble components are removed from that material. The non-tobacco extracted plant material is typically highly extracted, meaning a substantial amount of the aqueous soluble portion of the plant material has been removed. For example, a water-extracted pulp can be obtained by extracting significant amounts of water soluble components from the plant material. For example, certain water-extracted plant materials can comprise less than about 20 weight percent, and often less than about 10 weight percent water soluble components; and depending upon processing conditions, certain water-extracted plant materials can be virtually free of water soluble components (e.g., less than about 1 weight percent water soluble components). One preferred water-extracted plant material is water extacted sugar beet pulp (e.g., water extracted sugar beet leaf pulp).

The ability of the non-tobacco plant material to act as a substrate, and hence sorb and carry aqueous tobacco extract, can be enhanced by removing at least a portion of the aqueous soluble portion of the non-tobacco plant material. As a result, for certain embodiments, the non-tobacco plant material can consist primarily of essentially water-insoluble material capable of acting as a substrate for sorption and retention of that tobacco extract. Note that the term "sorb" as used herein refers to incorporation of the aqueous tobacco extract into the non-tobacco plant material by any known process including absorption and adsorption. Reference to "absorb" or "absorption" in this document is not intended to be limiting in terms of the physical or chemical interaction between the non-tobacco substrate and the aqueous tobacco extract.

Certain embodiments of the smokeless tobacco composition of the invention possess sensory characteristics, such as taste, mouthfeel, moistness, coolness/heat, and/or fragrance, that are similar to, or different from, the sensory characteristics of conventional smokeless tobacco products containing shredded or particulate pieces of tobacco laminae and/or stem. Reduced levels of water-soluble material within the non-tobacco plant material can provide for enhanced aqueous tobacco extract absorption, and also can assist in providing resulting products that exhibit reduced tackiness (e.g., that can impede optimal automation of the production process for the final smokeless tobacco product). In particular, the selection of preferred non-tobacco materials can depend up the ability of those materials to exhibit sufficiently high flowability in order to be efficiently and effectively processed using pouching equipment of the type conventionally used for various snus types of products.

The extracted non-tobacco plant material is typically used in a form that can be described as shredded, ground, granulated, fine particulate, or powder form. The manner by which the plant material is provided in a finely divided or powder type of form may vary. Preferably, plant parts or pieces are comminuted, ground or pulverized into a particulate form using equipment and techniques for grinding, milling, or the like. Most preferably, the plant material is relatively dry in form during grinding or milling, using equipment such as hammer mills, cutter heads, air control mills, or the like. The extracted non-tobacco plant material typically has an average particle size of about 0.3 to about 2 mm, more often about 0.5 to about 1.5 mm, and most often about 0.75 to about 1.25 mm (e.g., about 1 mm).

The tobacco material can be subjected to pasteurization treatment, pasteurization process conditions, or other suitable heat treatment process steps. Tobacco materials that have not been subjected to extraction treatment can be subjected to pasteurization treatment. Processed tobacco materials, including tobacco extracts, also can be subjected to pasteurization treatment. Typical pasteurization process conditions involve subjecting the tobacco material, which most preferably is in moist form, to heat treatment. The heat treatment can be carried out in an enclosed vessel (e.g., one providing for a controlled atmospheric environment, controlled atmospheric components, and a controlled atmospheric pressure), or in a vessel that is essentially open to ambient air. The heat treatment, which is provided by subjecting the tobacco material to a sufficiently high temperature for a sufficient length of time, has the ability to alter the overall character or nature of the combined material to a desired degree. For example, the heat treatment can be used to provide a desired color or visual character to the tobacco material, desired sensory properties to the tobacco material, or a desired physical nature or texture to the tobacco material. In addition, the heat treatment causes the tobacco material to experience a treatment characteristic of a pasteurization type of treatment. As such, certain types and amounts of spores, mold, microbes, bacteria, and the like can be rendered inactive, or the enzymes generated thereby can be denatured or otherwise rendered inactive. Certain components that are rendered inactive, or are otherwise effectively reduced in number, are biological agents (e.g., enzymes) that have the capability of promoting formation of tobacco-specific nitrosamines. Pasteurization techniques are set forth, for example, on the websites of the U.S. Food and Drug Administration and the U.S. Department of Agriculture. Exemplary types of pasteurization equipment, methodologies and process conditions also are set forth in US Patent Appl. Pub. Nos. 2009/0025738 to Mua et al. and 2009/0025739 to Brinkley et al., which are incorporated by reference herein.

The non-tobacco plant material also can be subjected to pasteurization treatment, pasteurization process conditions, or other suitable heat treatment process steps. Additionally, the combined mixture of non-tobacco plant material and tobacco material (e.g., the tobacco extract) can be subjected to aforementioned types of heat treatment process steps.

If desired the tobacco material, non-tobacco plant material, and/or combined mixture of tobacco material and non-tobacco material can be subjected to irradiation sufficient to provide the benefits of pasteurization treatment.

The non-tobacco plant material can be combined with the tobacco material in a number of ways. For example, solid spray-dried particles of the tobacco extract can be combined with the non-tobacco plant material. Alternatively, the tobacco extract can be in liquid form and sprayed on, or otherwise incorporated into, the non-tobacco plant material. In one embodiment, the extracted non-tobacco plant material can be placed in a jacketed mixer and the aqueous tobacco extract is sprayed into the mixer as the mixer contents are agitated.

For the tobacco product, the amount of tobacco material relative to the non-tobacco plant material can vary. The dry weight ratio of non-tobacco plant material (whether aqueously extracted, not extracted, or a combination thereof) to aqueous tobacco extract is typically about 4:1 to about 1:4, about 2:1 to about 1:2, and often about 1.5:1 to about 1:1.5. For example, one representative formulation can be provided using about 65 parts aqueous extracted tobacco extract and about 35 parts sugar beet pulp, and another representative formulation can be provided using about 45 parts aqueous extracted sugar beet pulp and about 55 parts aqueous extracted tobacco extract, each on a dry weight basis.

Further additives can be admixed with, or otherwise incorporated within, the combined non-tobacco plant material and tobacco material mixture that forms the basis of the smokeless tobacco composition or formulation of the present invention. The additives can be artificial, or can be obtained or derived from herbal or biological sources. Exemplary types of additives include salts (e.g., sodium chloride, potassium chloride, sodium citrate, potassium citrate, sodium acetate, potassium acetate, and the like), natural sweeteners (e.g., fructose, sucrose, glucose, maltose, vanillin, ethylvanillin glucoside, mannose, galactose, lactose, and the like), artificial sweeteners (e.g., sucralose, saccharin, aspartame, acesulfame K, neotame and the like), organic and inorganic fillers (e.g., grains, processed grains, puffed grains, maltodextrin, dextrose, calcium carbonate, calcium phosphate, corn starch, lactose, manitol, xylitol, sorbitol, finely divided cellulose, and the like), binders (e.g., povidone, sodium carboxymethylcellulose and other modified cellulosic types of binders, sodium alginate, xanthan gum, starch-based binders, gum arabic, lecithin, and the like), pH adjusters or buffering agents (e.g., metal hydroxides, preferably alkali metal hydroxides such as sodium hydroxide and potassium hydroxide, and other alkali metal buffers such as metal carbonates, preferably potassium carbonate or sodium carbonate, or metal bicarbonates such as sodium bicarbonate, and the like), colorants (e.g., dyes and pigments, including caramel coloring and titanium dioxide, and the like), humectants (e.g., glycerin, propylene glycol, and the like), oral care additives (e.g., thyme oil, eucalyptus oil, and zinc), preservatives (e.g., potassium sorbate, and the like), syrups (e.g., honey, high fructose corn syrup, and the like), disintegration aids (e.g., microcrystalline cellulose, croscarmellose sodium, crospovidone, sodium starch glycolate, pregelatinized corn starch, and the like), flavorant and flavoring mixtures, antioxidants, and mixtures thereof. If desired, the additive can be microencapsulated as set forth in US Patent Appl. Pub. No. 2008/0029110 to Dube et al.

Representative buffers include metal carbonates, metal bicarbonates, and mixtures thereof. For example, a representative buffer can be composed of virtually all sodium carbonate, and another representative buffer can be composed of virtually all sodium bicarbonate. Mixtures of buffer can be formulated from about 1 weight part sodium carbonate and about 99 weight parts sodium bicarbonate; from about 1 weight part sodium bicarbonate and about 99 weight parts sodium carbonate; or from about 50 weight parts sodium carbonate and about 50 weight parts sodium bicarbonate.

As used herein, a "flavorant" or "flavoring agent" is any flavorful or aromatic substance capable of altering the sensory characteristics associated with the smokeless tobacco composition. Exemplary sensory characteristics that can be modified by the flavorant include, taste, mouth feel, moistness, coolness/heat, and/or fragrance/aroma. The flavorants can be natural or synthetic, and the character of these flavors can be described as, without limitation, fresh, sweet, herbal, confectionary, floral, fruity or spice. Specific types of flavors include, but are not limited to, vanilla, coffee, chocolate, cream, mint, spearmint, menthol, peppermint, wintergreen, lavender, cardamon, nutmeg, cinnamon, clove, cascarilla, sandalwood, honey, jasmine, ginger, anise, sage, licorice, lemon, orange, apple, peach, lime, cherry, and strawberry. Flavorants utilized in the invention also can include components that are considered moistening, cooling or smoothening agents, such as eucalyptus. These flavors may be provided neat (i.e., alone) or in a composite (e.g., spearmint and menthol or orange and cinnamon).

The aforementioned types of additives can be employed together (e.g., as additive formulations) or separately (e.g., individual additive components can be added at different stages involved in the preparation of the final tobacco product). In certain circumstances, various additives can be combined with either or both of the non-tobacco plant material and the tobacco material at times before, during or after pasteurization process steps. For example, various types of salt additives and pH adjuster additives can be added to the tobacco material prior to, or during, pasteurization process steps. Alternatively, aromatic flavoring additives, humectants and artificial sweetener additives can be added to a processed mixture of tobacco material and non-tobacco plant material after most processing steps involved in the formation of the tobacco product are complete. The relative amounts of the various components within the smokeless tobacco formulation may vary, and typically are selected so as to provide the desired sensory and performance characteristics to the tobacco product.

If necessary for downstream processing of the smokeless tobacco product, such as pouching, a flow aid can also be added to the material in order to enhance flowability of the particulate smokeless tobacco material. Exemplary flow aids include microcrystalline cellulose, polyethylene glycol, calcium stearate, magnesium stearate, and zinc stearate. When present, a representative amount of flow aid may make up at least about 1 percent or at least about 3 percent, of the total dry weight of the formulation. Preferably, the amount of flow aid within the formulation will not exceed about 25 percent, and frequently will not exceed about 10 percent, of the total dry weight of the formulation.

The manner by which the various components of the smokeless tobacco product are combined may vary. The various components of the product can be contacted, combined, or mixed together in conical-type blenders, mixing drums, ribbon blenders, or the like. As such, the overall mixture of various components with the non-tobacco plant material/tobacco material combination may be relatively uniform in nature. See also, for example, the types of methodologies set forth in U.S. Pat. Nos. 4,148,325 to Solomon et al.; U.S. Pat. No. 6,510,855 to Korte et al.; and U.S. Pat. No. 6,834,654 to Williams, each of which is incorporated herein by reference. Manners and methods for formulating snus type tobacco formulations will be apparent to those skilled in the art of snus tobacco product production.

The tobacco composition can be used as a smokeless tobacco product or incorporated into smokeless tobacco product, and as such, can make up virtually all or a portion of a smokeless tobacco product. The tobacco composition can be used as loose moist snuff, loose dry snuff, chewing tobacco, pelletized tobacco pieces (e.g., having the shapes of pills, tablets, spheres, coins, beads, obloids or beans), extruded or formed tobacco strips, pieces, tubes, rods, cylinders or sticks, finely divided ground powders, finely divided or milled agglomerates of powdered pieces and components, flake-like pieces, molded processed tobacco pieces, pieces of tobacco-containing gum, rolls of tape-like films, readily water-dissolvable or water-dispersible films or strips (e.g., US Pat. App. Pub. No. 2006/0198873 to Chan et al.), or capsule-like materials possessing an outer shell (e.g., a pliable or hard outer shell that can be clear, colorless, translucent or highly colored in nature) and an inner region possessing tobacco or tobacco flavor (e.g., a Newtoniam fluid or a thixotropic fluid incorporating tobacco of some form). Various types of smokeless tobacco products are set forth in U.S. Pat. No. 1,376,586 to Schwartz; U.S. Pat. No. 3,696,917 to Levi; U.S. Pat. No. 4,513,756 to Pittman et al.; U.S. Pat. No. 4,528,993 to Sensabaugh, Jr. et al.; U.S. Pat. No. 4,624,269 to Story et al.; U.S. Pat. No. 4,987,907 to Townsend; U.S. Pat. No. 5,092,352 to Sprinkle, III et al.; and U.S. Pat. No. 5,387,416 to White et al.; US Pat. App. Pub. No. 2005/0244521 to Strickland et al.; PCT WO 04/095959 to Arnarp et al.; PCT WO 05/063060 to Atchley et al.; PCT WO 05/004480 to Engstrom; PCT WO 05/016036 to Bjorkholm; and PCT WO 05/041699 to Quinter et al.; and U.S. patent application Ser. No. 12/638,394, filed Dec. 15, 2009, to Mua et al.; each of which is incorporated herein by reference. See also, the types of smokeless tobacco formulations, ingredients, and processing methodologies set forth in U.S. Pat. No. 6,953,040 to Atchley et al. and U.S. Pat. No. 7,032,601 to Atchley et al.; US Pat. Appl. Pub. Nos. 2002/0162562 to Williams; 2002/0162563 to Williams; 2003/0070687 to Atchley et al.; 2004/0020503 to Williams, 2005/0178398 to Breslin et al.; 2006/0191548 to Strickland et al.; 2007/0062549 to Holton, Jr. et al.; 2007/0186941 to Holton, Jr. et al.; 2007/0186942 to Strickland et al.; 2008/0029110 to Dube et al.; 2008/0029116 to Robinson et al.; 2008/0029117 to Mua et al.; 2008/0173317 to Robinson et al.; and 2008/0209586 to Neilsen et al.; and PCT WO 2009/004488 to Crawford et al., each of which is incorporated herein by reference.

The moisture content of the smokeless tobacco product prior to use by a consumer can vary. Typically, the moisture content of the smokeless tobacco product, as present within a snus pouch prior to insertion into the mouth of the user, is less than about 55 weight percent, generally is less than about 50 weight percent, and often is less than about 45 weight percent. Certain types of smokeless tobacco products have moisture contents, prior to use, of less than about 15 weight percent, frequently less than about 10 weight percent, and often less than about 5 weight percent. For certain smokeless tobacco products, such as those incorporating snus types of tobacco compositions, the moisture content may exceed 20 weight percent, and often may exceed 30 weight percent. For example, a representative snus type product may possess a tobacco composition exhibiting a moisture content of about 25 weight percent to about 50 weight percent, preferably about 30 weight percent to about 40 weight percent.

The manner by which the moisture content of the tobacco product is controlled may vary. For example, the tobacco product can be subjected to thermal or convection heating. As a specific example, the formulation may be oven-dried, in warmed air at temperatures of about 40° C. to about 95° C., with a preferred temperature range of about 60° C. to about 80° C., for a length of time appropriate to attain the desired moisture content. Alternatively, tobacco formulations may be moistened using casing drums, conditioning cylinders or drums, liquid spray apparatus, ribbon blenders, mixers available as FKM130, FKM600, FKM1200, FKM2000 and FKM3000 from Littleford Day, Inc., Plough Share types of mixer cylinders, and the like.

The acidity or alkalinity of the smokeless tobacco product, which is often characterized in terms of pH, can vary. Typically, the pH of that formulation is at least about 6.5, and preferably at least about 7.5. Typically, the pH of that formulation will not exceed about 9, and often will not exceed about 9.0. A representative tobacco formulation exhibits a pH of about 6.8 to about 8.8. A representative technique for determining the pH of a smokeless tobacco formulation involves dispersing 5 g of that formulation in 100 ml of high performance liquid chromatography water, and measuring the pH of the resulting suspension/solution (e.g., with a pH meter).

Representative smokeless tobacco formulations of the invention may incorporate mixtures comprised of greater than about 5 percent tobacco material and less than about 95 percent non-tobacco plant material, greater than about 10 percent tobacco material and less than about 90 percent non-tobacco plant material, greater than about 15 percent tobacco material and less than about 85 percent non-tobacco plant material, greater than about 20 percent tobacco material and less than about 80 percent non-tobacco plant material, greater than about 30 percent tobacco material and less than about 70 percent non-tobacco plant material, greater than about 40 percent tobacco material and less than about 60 percent non-tobacco plant material, and greater than about 50 percent tobacco material and less than about 50 percent non-tobacco plant material, based on the total dry weight of the components of the smokeless tobacco formulation. The particular percentages and choice of ingredients can vary depending upon the desired flavor, texture, and other characteristics. In certain embodiments, the combined tobacco extract and non-tobacco plant material (e.g., whether extracted non-tobacco plant material, processed but not extracted non-tobacco plant material, or a mixture thereof) can comprise at least about 5, at least about 10, at least about 20, at least about 30, at least about 40, at least about 50, at least about 60, at least about 70, at least about 80, and at least about 90, weight percent of the total dry weight of the final formulation of the tobacco product.

Descriptions of various components of snus types of products and components thereof also are set forth and referenced in U.S. Pat. App. Pub. Nos. 2009/0025738 to Mua et al. and 2010/0018539 to Brinkley et al.; which are incorporated herein by reference. Snus types of products can be manufactured using equipment such as that available as SB 51-1/T, SBL 50 and SB 53-2/T from Merz Verpackungmaschinen GmBH. Snus pouches can be provided as individual pouches, or a plurality of pouches (e.g., 2, 4, 5, 10, 12, 15, 20, 25 or 30 pouches) can connected or linked together (e.g., in an end-to-end manner) such that a single pouch or individual portion can be readily removed for use from a one-piece strand or matrix of pouches.

Typically, for a snus type of tobacco product, the amount of smokeless tobacco product within each individual portion (e.g., within each pouch) is such that there is at least about 50 mg, often at least about 150 mg, and frequently at least about 250 mg, of dry weight smokeless tobacco composition; and less than about 700 mg, often less than about 500 mg, and frequently less than about 300 mg, of dry weight smokeless tobacco composition. For example, snus type smokeless tobacco products can have the form of so-called "portion snus." In one typical embodiment, the amount of smokeless tobacco formulation within each pouch is between about 100 mg and about 400 mg. Depending upon the moisture content of the snus type of product, the overall moist weight of representative tobacco mixtures within each pouch often can range from about 500 mg to about 1500 mg (eg., about 600 mg, about 1000 mg and about 1300 mg).

The smokeless tobacco product can be packaged within a package and container. For example, pouches of snus type product can be packaged within a short, rounded edge, generally cylindrical container of the type traditionally used for the marketing of snus types of products. See also, for example, the types of representative snuff-box types of designs set forth in PCT WO 2005/016036 to Bjorkholm. Other types of containers that can be suitably modified are plastic or metal type containers of the type set forth in U.S. Pat. No. 7,014,039 to Henson et al. See, also, the types of hard containers that have been used for the commercial distribution of Camel Snus, Camel Orbs, Camel Strips and Camel Sticks by R. J. Reynolds Tobacco Company; Revel Mint Tobacco Packs type of smokeless tobacco product by U.S. Smokeless Tobacco Corporation; SkoalDry by U.S. Smokeless Tobacco Co. and "taboka" by Philip Morris USA. See also, for example, the various types of containers for smokeless types of products that are set forth in U.S. Pat. No. 7,537,110 to Kutsch et al.; U.S. Pat. No. 7,584,843 to Kutsch et al.; D592,956 to Thiellier and D594,154 to Patel et al.; US Pat. Pub. Nos. 2008/0173317 to Robinson et al.; 2009/0014343 to Clark et al.; 2009/0250360 to Bellamah et al.; 2009/0266837 to Gelardi et al.; 2009/0223989 to Gelardi and 2009/0230003 to Thiellier; and U.S. patent application Ser. No. 29/342,212, filed Aug. 20, 2009, to Bailey et al.; Ser. No. 12/412,809, filed Mar. 27, 2009, to Bailey et al.; Ser. No. 12/425,180, filed Apr. 16, 2009, to Bailey et al.; and Ser. No. 12/685,819, filed Jan. 12, 2010, to Bailey et al.; which are incorporated herein by reference.

EXPERIMENTAL

Aspects of the present invention are more fully illustrated by the following examples, which are set forth to illustrate certain aspects of the present invention and are not to be construed as limiting thereof. Unless otherwise noted, all parts and percentages are by weight.

Example 1

A tobacco extract is prepared by extracting a tobacco blend with water, and collecting the resulting aqueous extract as follows:

A blend of tobacco that is about 60 parts laminae and about 40 parts stem is provided. The blend of tobacco is made up of a blend of various dark air cured and sun cured tobaccos. The tobaccos of the blend are cured and aged, and those tobaccos are used without purposeful application of additives, such as casings and top dressings. The tobacco is milled to a fine particle size (e.g., about −18+60 mesh). Then, about 1 part tobacco particles (having a moisture content of about 10 percent) are contacted with about 8 parts hot water (e.g., water heated to about 140° F. to about 160° F.). After about 1 hour, the liquid extract of tobacco water solubles within water are separated from the water insoluble pulp using a type of centrifuge available as Sharples 3600 Decanter Centrifuge, operating as about 2000 rpm with a fluid flow of about 40 gallons per minute. The resultant liquid tobacco extract that is collected is filtered using a Sanborn (Serial No. MC86-300, M Type 32X18 Perf.) centrifugal filter equipped with a 10 micron filter bag. The resulting aqueous tobacco extract then is concentrated to a total tobacco solubles content of about 43 percent using a wiped film evaporator operating at about 195° F. The aqueous tobacco extract then is placed in a sealed container, and is stored by refrigeration at about 40° F.

The aqueous tobacco extract is heated open to atmosphere at about 200° F. for about 1 hour while that mixture is mixed using a M5 Littleford Mixer set at about 32 rpm. During operation, the mixer lid is closed, but the mixer remains vented to atmosphere; and as such, no significant loss of moisture occurs during such heat treatment. Then, the liquid extract is cooled to about 170° F. At that point, a buffer composed of sodium bicarbonate is added to the mixture. At that point, the liquid extract is about 40 parts tobacco solubles, about 53 parts water, and about 7 parts buffer. The resulting liquid tobacco extract that is treated with buffer is held at about 170° F., with continued mixing, for approximately an additional 20 minutes. Prior to addition of the buffer mixture, the pH of the liquid tobacco extract is about 5.2, and at about 20 minutes after addition of the buffer mixture, the pH of the liquid extract is about 8.6. Then, the treated liquid tobacco extract is cooled to ambient temperature.

Water-extracted sugar beet pulp is provided and collected as follows:

Processed sugar beet pulp available as Fibrex 610-22 from International Fiber Corporation is provided. Then, about 10 parts of that sugar beet pulp (having a moisture content of about 6 percent) is contacted with about 200 parts hot water (e.g., water heated to about 120° F.) in a mixing kettle. After heating and slow stirring the resulting mixture for about 1 hour, the liquid extract of the sugar beet water solubles within water are separated from the water insoluble pulp using filtering process that involves squeezing the liquid through a mesh sock (e.g., a screen or filter comparable to the mesh of a U.S. 50 mesh screen). The resulting wet pulp is dried overnight on a metal sheet in an oven set at a temperature of 140° F. About 7 parts of the resulting water-extracted pulp (having a moisture content of about 1 percent) is collected.

A tobacco product is manufactured from the liquid tobacco extract and the water-extracted sugar beet pulp as follows:

About 60 parts (on a dry weight basis) of the dried, extracted sugar beet pulp is contacted with about 32 parts (on a dry weight basis) of the liquid tobacco extract. To that mixture is added about 1.3 parts sodium chloride. Then, a flavor package comprising about 3.5 parts propylene glycol, 1.5 parts sucralose and about 2 parts of a flavoring mixture is added; and each of the foregoing is within sufficient water so as to raise the moisture content of the final product to about 25 percent. As such, the processed non-tobacco vegetable material provides a substrate that carries the aqueous tobacco extract that is absorbed thereby. The resulting tobacco product is aged under refrigeration at about 40° F. for approximately 3 days. Then, about 0.6 g of the tobacco product is placed within the type of fleece pouch used for manufacture of Camel Snus Frost by R. J. Reynolds Tobacco Company to provide a snus type of tobacco product.

The resulting tobacco product is used as follows: About 15 snus type pouches are packaged in a conventional type of snus tin container. In use, the hard container is opened, a pouch is removed therefrom, and the pouch is enjoyed by the consumer. The hard container is manually resealed, and additional pouches are removed from that container by the consumer as desired. If desired, containers can be equipped with suitable seals or grommets, such that when an opened container is re-shut, a good seal is provided.

The smokeless tobacco product having the form of snus typically is used by placing one pouch containing the smokeless tobacco composition in the mouth of a human subject. During use, saliva in the mouth of the user causes some of the components of the smokeless tobacco formulation to pass through the water-permeable pouch and into the mouth of the user. The pouch preferably is not chewed or swallowed. The user is provided with tobacco flavor and satisfaction, and is not required to spit out any portion of the tobacco formulation. After about 10 minutes to about 60 minutes, preferably about 15 minutes to about 45 minutes, of use and enjoyment, substantial amounts of the smokeless tobacco composition have been ingested by the human subject, and the pouch may be removed from the mouth of the human subject for disposal.

Example 2

A tobacco product of the general type set forth in Example 1 is provided as follows:

An aqueous tobacco extract is provided generally in the manner set forth in Example 1. Processed sugar beet pulp available as Fiberx 610-22 from International Fiber Corporation is provided, and is used without further processing (e.g., the processed sugar beet pulp is not subjected to water extraction). Then, a tobacco product is manufactured from the liquid tobacco extract and the sugar beet pulp.

About 60 parts (on a dry weight basis) of the sugar beet pulp is contacted with about 32 parts (on a dry weight basis) of the liquid tobacco extract (which is in liquid form. To that mixture is added about 1.3 parts sodium chloride. Then, about 3.5 parts propylene glycol, 1.5 parts sucralose and about 2 parts of a flavoring mixture is added; and each of the foregoing is within sufficient water so as to raise the moisture content of the final product to about 25 percent. The resulting tobacco product is aged under refrigeration at about 40° F. for approximately 3 days. Then, about 0.6 g of the tobacco product is placed within the type of fleece pouch and used in the manner set forth in Example 1.

Example 3

A tobacco product of the general type set forth in Example 1 is provided. An aqueous tobacco extract and a water-extracted sugar beet pulp each are provided, generally in the manner set forth in Example 1. However, rather than adding the sodium chloride to the tobacco extract and sugar beet pulp mixture, the salt is added at other stages of the tobacco product preparation process, as follows:

In one embodiment, the salt is added to the aqueous tobacco extract prior to the pasteurization step of that tobacco extract.

In one embodiment, the salt is mixed with the wet water-extracted sugar beet pulp prior to processing steps involved in drying that sugar beet pulp.

In one embodiment, the salt is added to the mixed aqueous tobacco extract and sugar beet pulp at the end of the drying process just prior to final flavor package addition.

Example 4

A tobacco product of the general type set forth in Example 1 is provided as follows:

A water-extracted sugar beet pulp is provided, generally in the manner set forth in Example 1.

A blend of tobacco that is about 60 parts laminae and about 40 parts stem is provided. The blend of tobacco is made up of a blend of various dark air cured and sun cured tobaccos. The tobaccos of the blend are cured and aged, and those tobaccos are used without purposeful application of additives, such as casings and top dressings. The tobacco is milled to a fine particle size (e.g., about −18+60 mesh). Then, about 1 part tobacco particles (having a moisture content of about 10 percent) are contacted with about 8 parts hot water (e.g., water heated to about 140° F. to about 160° F.). After about 1 hour, the liquid extract of tobacco water solubles within water are separated from the water insoluble pulp using a type of centrifuge available as Sharples 3600 Decanter Centrifuge, operating as about 2000 rpm with a fluid flow of about 40 gallons per minute. The resultant liquid tobacco extract that is collected is filtered using a Sanborn (Serial No. MC86-300, M Type 32X18 Perf.) centrifugal filter equipped with a 10 micron filter bag. The resulting aqueous tobacco extract then is concentrated to a total tobacco solubles content of about 43 percent using a wiped film evaporator operating at about 195° F.

A tobacco product is manufactured from the liquid tobacco extract and the water-extracted sugar beet pulp as follows:

About 60 parts (on a dry weight basis) of the dried, extracted sugar beet pulp is contacted with about 32 parts (on a dry weight basis) of the liquid tobacco extract. To that mixture is added about 1.3 parts sodium chloride. The mixture is heated open to atmosphere at about 200° F. for about 1 hour while that mixture is mixed using a M5 Littleford Mixer set at about 32 rpm. During operation, the mixer lid is closed, but the mixer remains vented to atmosphere; and as such, no significant loss of moisture occurs during such heat treatment. Then, the mixture is cooled to about 170° F. At that point, a sodium bicarbonate buffer is added to the mixture. At that point, the liquid mixture is about 46 parts sugar beet pulp, about 21 parts tobacco solubles, about 28 parts water, and about 4 parts buffer. If desired, additional buffer can be added to the mixture over several hours (e.g., about 2 to about 4 hours) such that the amount of buffer within the mixture is about 9 parts buffer. The resulting mixture that is treated with buffer is held at about 170° F., with continued mixing, for approximately an additional 20 minutes. Prior to addition of the buffer mixture, the pH of the mixture is about 5.2, and at about 20 minutes after addition of the buffer mixture, the pH of the mixture is about 8.6. Then, the mixture is cooled to ambient temperature.

Then, about 3.5 parts propylene glycol, 1.5 parts sucralose and about 2 parts of a flavoring mixture is added; and each of the foregoing is within sufficient water so as to raise the moisture content of the final product to about 25 percent.

Example 5

A tobacco product is provided as follows: A tobacco snus formulation of the type employed by R. J. Reynolds in a commercially available Camel Snus Winterchill is provided. The tobacco snus formulation is modified so as to have a moisture content of about 25 percent.

A tobacco extract and processed sugar beet pulp mixture of the type described in Example 1 is provided. That mixture is modified so as to have a moisture content of about 25 percent.

About 60 parts of the tobacco snus formulation, and about 40 parts of the tobacco extract and processed beet pulp mixture are milled to a desired particle size, buffer is added, and the resulting mixture is pasteurized. After pasteurization, the desired flavor package or ingredients are added to the resulting pasteurized mixture.

The resulting mixture then is portioned into a snus type of pouch.

Example 6

A tobacco product generally of the type described in Example 5 is provided; except that the tobacco extract and processed sugar beet pulp mixture is a tobacco extract and processed sugar beet pulp mixture of the type described in Example 2.

Many modifications and other embodiments of the invention will come to mind to one skilled in the art to which this invention pertains having the benefit of the teachings presented in the foregoing description. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

We claim:

1. A smokeless tobacco composition adapted for oral use, comprising a non-tobacco plant material carrying a sorbed aqueous tobacco extract, wherein the non-tobacco plant material is selected from the group consisting of wheat, oat, corn, potato, pea, apple, cotton, bamboo, and combinations thereof and wherein the non-tobacco plant material may optionally further comprise sugar beet, wherein the non-tobacco plant material is in the form of an aqueous-extracted pulp material, and wherein the aqueous extracted pulp material and the sorbed aqueous tobacco extract comprise at least about 70 percent of the total dry weight of the smokeless tobacco composition.

2. The smokeless tobacco composition of claim 1, wherein the weight ratio of non-tobacco plant material to aqueous tobacco extract is about 2:1 to about 1:2.

3. The smokeless tobacco composition of claim 1, wherein the weight ratio of non-tobacco extracted plant material to aqueous tobacco extract is about 1.5:1 to about 1:1.5.

4. The smokeless tobacco composition of claim 1, wherein the non-tobacco plant material is in particulate form and has an average particle size of about 0.3 to about 2 mm.

5. The smokeless tobacco composition of claim 4, wherein the non-tobacco plant material has an average particle size of about 0.5 to about 1.5 mm.

6. The smokeless tobacco composition of claim 1, wherein the aqueous-extracted pulp material comprises no more than about 20 weight percent aqueous soluble non-tobacco material on a dry weight basis.

7. The smokeless tobacco composition of claim 6, wherein the aqueous-extracted pulp material comprises no more than about 10 weight percent aqueous soluble non-tobacco material on a dry weight basis.

8. The smokeless tobacco composition of claim 1, further comprising an additive selected from the group consisting of flavorants, fillers, binders, buffering agents, colorants, humectants, oral care additives, preservatives, syrups, disintegration aids, antioxidants, additives derived from an herbal or botanical source, flow aids, and combinations thereof.

9. The smokeless tobacco composition of claim 1, further comprising a natural or artificial sweetener.

10. The smokeless tobacco composition of claim 1, further comprising a salt.

11. The smokeless tobacco composition of claim 1, further comprising a tobacco material in the form of a particulate tobacco material.

12. The smokeless tobacco composition of claim 1, further comprising a buffering agent.

13. The smokeless tobacco composition of claim 1, further comprising a flow aid.

14. The smokeless tobacco composition of claim 13, wherein the flow aid is selected from the group consisting of microcrystalline cellulose, polyethylene glycol, calcium stearate, magnesium stearate, zinc stearate, and combinations thereof.

15. The smokeless tobacco composition of claim 1, further comprising up to about 5 dry weight percent of one or more natural or artificial sweeteners, up to about 5 dry weight percent of one or more buffering agents, and up to about 5 dry weight percent of one or more salts.

16. The smokeless tobacco composition of claim 1, wherein the non-tobacco plant material is in the form of a particulate, aqueous-extracted pulp material, and the weight ratio of non-tobacco plant material to aqueous tobacco extract is about 2:1 to about 1:2;

further comprising:

about 0.5 to about 10 weight percent of one or more buffering agents;

about 0.5 to about 5 weight percent of one or more natural or artificial sweeteners;

about 0.5 to about 5 weight percent of one or more humectants; and about 0.5 to about 5 weight percent of one or more salts.

17. The smokeless tobacco composition of claim 1, wherein the aqueous extracted pulp material and the sorbed aqueous tobacco extract are in pasteurized form.

* * * * *